US006982015B2

(12) United States Patent
Atkinson et al.

(10) Patent No.: US 6,982,015 B2
(45) Date of Patent: Jan. 3, 2006

(54) REDUCED ENERGY BLASTING AGENT AND METHOD

(75) Inventors: Kerry S. Atkinson, Lehi, UT (US); John B. Halander, Murray, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 454 days.

(21) Appl. No.: 09/864,339

(22) Filed: May 25, 2001

(65) Prior Publication Data

US 2003/0029346 A1 Feb. 13, 2003

(51) Int. Cl.
*D03D 23/00* (2006.01)
*C06B 45/00* (2006.01)

(52) U.S. Cl. ..... 149/109.6; 149/2; 149/46

(58) Field of Classification Search ..... 149/2, 149/45, 46, 109.6
See application file for complete search history.

(56) References Cited

U.S. PATENT DOCUMENTS 3,642,547 A * 2/1972 Conrad ..... 149/2
4,008,108 A * 2/1977 Chrisp ..... 149/109.6
4,474,628 A 10/1984 Sudweeks et al.
4,500,369 A * 2/1985 Tag et al. ..... 149/109.6
4,526,633 A * 7/1985 Lawrence et al. ..... 149/109.6
4,615,752 A 10/1986 Miller
4,676,849 A * 6/1987 Curtin et al. ..... 149/109.6
4,820,361 A 4/1989 McKenzie et al.
4,875,951 A * 10/1989 Prest et al. ..... 149/109.6
4,931,110 A 6/1990 McKenzie et al.
4,959,108 A * 9/1990 Waldock ..... 149/109.6
5,071,496 A 12/1991 Coursen et al.
5,099,763 A 3/1992 Coursen et al.
5,271,779 A * 12/1993 Engsbraten ..... 149/109.6
5,460,670 A * 10/1995 Cechanski ..... 149/109.6
5,670,739 A 9/1997 Patterson et al.
6,113,715 A 9/2000 Halander et al.
2002/0124918 A1 * 9/2002 De Segura et al. ..... 149/109.6

OTHER PUBLICATIONS

Guralnik, ed., "Webster's New World Dictionary of the American Language", 2nd College Edition, (1970), The World Publishing Company, pp. 1605-1606.*

* cited by examiner

*Primary Examiner*—Aileen Felton

(57) ABSTRACT

The present invention relates to a method of reducing the energy of an emulsion blasting agent as it is being loaded into a borehole and to an improved method of perimeter blasting wherein an energy reducing agent is added to and mixed uniformly throughout an emulsion blasting agent as it is being pumped or conveyed into a perimeter borehole to reduce the energy of the blasting agent to a desired level. In addition, by adding varying amount of gassing agents, the density and sensitivity of the emulsion blasting agent also can be controlled.

7 Claims, No Drawings

REDUCED ENERGY BLASTING AGENT AND METHOD

The present invention relates to an emulsion blasting agent of reduced energy prepared by the addition of an energy reducing agent, preferably water or an aqueous solution, in an amount sufficient to reduce the energy of the emulsion blasting agent to a desired level. The present invention further relates to a method of reducing the energy of an emulsion blasting agent as it is being loaded into a borehole and to an improved method of perimeter blasting wherein an energy reducing agent is added to and mixed uniformly throughout an emulsion blasting agent as it is being pumped or conveyed into a perimeter borehole to reduce the energy of the blasting agent to a desired level. In addition, by adding varying amount of gassing agents, the density and sensitivity of the emulsion blasting agent also can be controlled.

BACKGROUND

Emulsion blasting compositions are well-known in the art. As used herein the term "emulsion" refers to a water-in-oil emulsion comprising an inorganic oxidizer salt solution as a discontinuous phase and an organic liquid fuel as a continuous phase. When sensitized, the emulsion becomes an emulsion blasting agent. See for example, U.S. Pat. Nos. 4,474,628; 4,820,361; 4,931,110 and 6,113,715.

Emulsion blasting agents are fluid when initially formed, and can remain fluid or pumpable, or can become more firm, depending upon the viscosity of the organic liquid fuel and other additives. Emulsion blasting agents can be used in either bulk or packaged form and can be pumped on-site directly into boreholes. Alternatively, solid additives such as ammonium nitrate (AN) prills can be added to an emulsion, and depending upon the quantity of prills added, the resulting mixture can be either pumped or augered into boreholes. These properties and applications are well known in the art.

Perimeter blasting also is well known in the art. It is a method of perimeter control in rock excavation and involves various blasting techniques commonly used in mining and construction blasting applications. The purpose is to minimize and control overbreak in final rock excavation surfaces. Perimeter blasting techniques include presplitting, smooth wall blasting, line drilling, contour blasting, cushion blasting, fracture plane control blasting, air deck blasting and others. Presplitting, for example, is a surface blasting technique that involves the drilling and light blasting of parallel holes in the plane of the desired final rock surface. This is accomplished to generate stable final rock walls, rather than rough, ragged, unstable and overshot walls. The aim of presplitting is to load the holes in such a way that for a particular rock type and spacing, the borehole pressure will split the rock yet not exceed its dynamic compressive strength and cause crushing around the borehole. The loaded presplit boreholes are initiated before arrival of the main shock wave from the main blast. The resulting mechanical stability of the rock surface permits steeper and higher slopes, results in long term reduced maintenance costs of blasted surfaces, results in safer working conditions for blasting and excavation workers, minimizes final slope and scaling dressing costs, minimizes land area required for blasting operations and is more aesthetically desirable.

In smooth wall or smooth blasting, the rock surface to be preserved is on overhead horizontal or near horizontal surfaces such as in the arch section of a tunnel. As in presplitting, the blasting variables are hole diameter, burden and spacing, and the decoupled loading. The burden and spacing ratio and borehole pressure are designed to force a hole-to-hole fracture but are kept below the threshold of damage to rock from compressive failure. The benefits from smooth wall blasting are similar to those from presplitting.

The light loading or reduced burden in the perimeter boreholes can be accomplished in various ways. Packaged explosives typically are used that have a charge diameter that is significantly less (half or less) than the borehole diameter so that the charge is not coupled (decoupled) to the borehole. Low density, low velocity bulk products, such as ANFO containing polystyrene beads, also have been used to provide a low energy, decoupling effect and can be string-loaded. Other approaches are toe loading or air decking where product charges are placed only at the bottom or end of the hole, or decking, where charges are spaced to produce a discontinuous explosive column. Decoupling is less effective, however, in water-filled boreholes.

These prior perimeter blasting techniques require that different products or loading methods be employed between the perimeter holes and the main charge holes. This adds cost and complexity to the blasting process. In contrast, the present invention allows for the same product and essentially the same loading method to be used in both types of holes. The emulsion blasting agent to be used in the main charge, or at least the emulsion component of the blasting agent, is the same as that used in the perimeter holes, except that an energy reducing agent is added to and thoroughly mixed throughout the emulsion blasting agent as it is being introduced into the perimeter holes. Thus a lower energy, lower velocity charge is loaded into the perimeter hole, but the perimeter charge originates from the same base charge as used for the main blast. Moreover, the energy can be varied from hole to hole or even within or along the axis of the hole as desired by variably increasing or decreasing the amount of the energy reducing agent added.

Another advantage of the method of the present invention is that the energy of the emulsion blasting agent can be variably controlled along the axis of the borehole, from bottom to top in a vertical borehole or from back to front in a horizontal borehole, as the blasting agent is loaded. This can be accomplished not only by varying the amount of energy reducing agent added as described above but also by adding varying amounts of gassing agents to the emulsion blasting agent to reduce variably its density. In combination, the density, sensitivity, and energy of the emulsion blasting agent can be tailored and varied from hole to hole and even within a hole. Such tailoring can compensate for rock variations along the length of the borehole, increasing pressure heads with borehole depth and other factors.

Water has been added to emulsion blasting agents in the past, but for different purposes, in different amounts and/or by different methods. U.S. Pat. No. 5,099,763 the addition of water or a water-containing component to a blasting agent to form a non-uniform, marbled composition having two or more volume fractions of different compositions to reduce the detonation velocity of the blasting agent. U.S. Pat. No. 4,615,752 discloses the use of water to lubricate the flow of an emulsion blasting agent through a loading hose having a viscosity-increasing shear valve at or near the end of the hose. The lubricating water can either be allowed to escape prior to its entry into the valve or can be mixed into the emulsion blasting agent that can be deficient in water in contemplation of such mixing. The present invention differs from this prior art in that the water or aqueous solution added to the emulsion blasting agent in the present invention is added to the emulsion blasting agent in an amount sufficient to reduce significantly its energy and is mixed uniformly and homogeneously throughout the emulsion phase. In fact, when mixed in this manner the water or aqueous solution forms a second discontinuous droplet phase to that formed by the initial oxidizer salt solution component. This second discontinuous phase renders the emulsion blasting agent more sensitive and stable than if the water or aqueous solution were combined initially with the inorganic oxidizer salt solution or if they were not mixed uniformly and homogeneously throughout the emulsion phase. With the additional, optional inclusion of gassing agents, an emulsion blasting agent having variable energy, density and sensitivity can be formed imparting the advantages previously described.

SUMMARY

The present invention relates to a method of reducing the energy of an emulsion blasting agent and an improved method of perimeter blasting comprising (a) selecting an emulsion blasting agent of pre-determined formulation; (b) conveying the emulsion blasting agent; (c) adding an energy-reducing agent to the emulsion blasting agent as it is being conveyed; (d) mixing the energy-reducing agent uniformly and homogeneously into the emulsion blasting agent; (e) optionally, adding gassing agents to the emulsion blasting agent to reduce its density and increase its sensitivity; and (f) loading the conveyed emulsion blasting agent into a borehole or a perimeter borehole, respectively. The present invention also relates to an emulsion blasting agent of reduced energy wherein an energy reducing agent is added separately to and mixed uniformly and homogeneously throughout the emulsion blasting agent in an amount of from about 5% to about 22.5% by weight of the emulsion blasting agent.

DETAILED DESCRIPTION

The emulsion blasting agent of the present invention or used in the method of the present invention comprises a continuous phase of organic liquid fuel, a discontinuous phase of inorganic oxidizer salt solution and, optionally, a dispersion of sensitizing and density-reducing gas bubbles or density-reducing agent.

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Water miscible liquid fuels, also functioning as liquid extenders for water, can be used. These additional solid and/or liquid fuels can be added generally in amounts ranging up to about 25% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate (AN), but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred. AN and ANFO prills also can be added in solid form as part of the oxidizer salt in the final composition.

Water generally is employed in an amount of from 3% to about 30% by weight based on the total composition. It is commonly employed in emulsions in an amount of from about 5% to about 20%.

An emulsifier is used in forming the emulsion. Typical emulsifiers include sorbitan fatty esters, glycol esters, substituted oxazolines, alkylamines or their salts, derivatives thereof and the like. More recently, certain polymeric emulsifiers have been found to impart better stability to emulsions under certain conditions. U.S. Pat. No. 4,820,361 describes a polymeric emulsifier derivatized from trishydroxymethylaminomethane and polyisobutenyl succinic anhydride ("PIBSA"), which is particularly effective in combination with organic microspheres and is a preferred emulsifier. U.S. Pat. No. 4,784,706 discloses a phenolic derivative of polypropene or polybutene. Other derivatives of polypropene or polybutene have been disclosed. Preferably the polymeric emulsifier comprises polymeric amines and their salts or an amine, alkanolamine or polyol derivative of a carboxylated or anhydride derivatized olefinic or vinyl addition polymer. U.S. Pat. No. 4,931,110 discloses a polymeric emulsifier comprising a bis-alkanolamine or bis-polyol derivative or a bis-carboxylated or anhydride derivatized olefinic or vinyl addition polymer in which the olefinic or vinyl addition polymer chain has an average chain length of from about 10 to about 32 carbon atoms, excluding side chains or branching.

Chemical gassing agents preferably are added to the emulsion blasting agent preferably at or just prior to the time of pumping of the emulsion blasting agent into a borehole. Thus the chemical gassing agents or the reactive components thereof generally are added after the emulsion is formed. The addition generally is timed so that gassing will occur after or about the same time as further handling of the emulsion is completed so as to minimize loss, migration and/or coalescence of gas bubbles. Chemical gassing agents normally are soluble in the inorganic oxidizer salt or discontinuous phase of the emulsion and react chemically in the oxidizer salt phase under proper pH conditions to produce a fine dispersion of gas bubbles throughout the emulsion. The chemical gassing agents preferably comprise an aqueous solution of sodium nitrite and an acid such as citric or acetic acid. A gassing accelerator, such as thiocyanate, preferably can be added. When sodium nitrite and thiocyanate salt are combined in the oxidizer solution phase that has a pH of from about 3.5 to about 5.0, gas bubble generation commences. The nitrite salt is added in an amount of from less than 0.1% to about 0.6% by weight of the emulsion composition on a dry basis, and the thiocyanate or other accelerator is added in a similar amount to either the oxidizer solution discontinuous phase or the nitrite solution. In addition to chemical gassing agents, hollow spheres or particles made from glass, plastic or perlite may be added to provide further density reduction. The formation of gas bubbles reduces the density of the emulsion blasting agent and generally increases its sensitivity to detonation as is known in the art.

The emulsion phase may be formulated in a conventional manner. Typically, the oxidizer salt(s) first is dissolved in the water at an elevated temperature, depending upon the crystallization temperature of the salt solution. The aqueous oxidizer solution, then is added to a solution of the emulsifier and the immiscible liquid organic fuel, and the resulting mixture is stirred with sufficient vigor to produce an emulsion of the aqueous solution in a continuous liquid organic fuel phase.

The methods of the present invention comprise adding an energy-reducing agent and preferably gassing agents to the emulsion blasting agent as it is being conveyed into a borehole. (The phrase "as it is being conveyed" is intended to cover adding the energy-reducing agent either upstream or downstream of the conveyance means such as an emulsion pump.) The term "conveyed" includes pumping, extrusion or other means. For perimeter blasting, the density reducing agent can be added in an amount sufficient to lower the energy of the emulsion blasting agent to a level that allows for perimeter blasting to be conducted so as to achieve blasting results described previously. The energy reducing agent is mixed uniformly and homogeneously throughout the emulsion phase to form a second discontinuous phase, preferably by means of a dynamic mixer, homogenizing valve, static mixer or spray nozzle(s). Optionally but preferably, gassing agents are added to the emulsion blasting agent to reduce its density and increase its sensitivity, which may be necessary if the addition of the energy-reducing agent otherwise would materially decrease the blasting agent's sensitivity to detonation. The gassing agents can be combined either before or after the conveyance means such as an emulsion pump. The gassing agents are added in amounts sufficient to reduce the density of the emulsion blasting agent to a range of from about 0.60 g/cc to about 1.30 g/cc.

The energy-reducing agent is selected from the group consisting of water and aqueous solutions. The aqueous solutions contain a solute selected from the group consisting of inorganic oxidizer salts, urea, glycols and inorganic acids. The energy-reducing agent is added in an amount of from about 5% to about 22.5% by weight of the emulsion blasting agent, preferably in an amount of from about 7.5% to about 20%, and more preferably in an amount of from about 7.5% to about 17.5%.

By variably controlling the amount of energy reducing agent and gassing agents added, the energy, density and sensitivity of the emulsion blasting agent can be varied as desired from borehole to borehole, or within a borehole along its length, to provide blasting versatility as described above. Further, by starting with a single emulsion blasting agent base that can be used for all holes in the blast pattern, simplicity and economy are obtained. Thus the present invention provides for a variable end product from a single initial product and is particularly suitable for perimeter blasting.

The invention is further illustrated by reference to the following examples.

EXAMPLE 1

Four emulsion blasting agents mixes (1–4) were prepared and loaded into 3-inch diameter by 24-inch schedule 40 steel pipes (Table 1). Prior to loading mixes 3 and 4 into the pipes, an energy reducing agent (water) was dispersed homogeneously into the emulsion blasting agent at 10% and 20%, respectively, by weight of the emulsion. This was accomplished with a hand-held mixer that ran for approximately one minute. Density reducing (gassing) agents were added and similarly mixed into mixes 2, 3 and 4. (Mix 1 was used as a baseline and therefore had no energy or density reducing agents added.) The gassed mixes were allowed to sit for about one hour before being detonated.

Energies were measured upon detonation of the mixes. A comparison of the measured energies indicates that total energy was reduced about 34% from 718 cal/g (mix 1) to 474 cal/g (mix 4, which was a gassed emulsion blasting agent with 20 percent energy-reducing agent). The volume energy reduction correspondingly was about 55% from 869 cal/cc to 389 cal/cc. The shock to bubble energy ratio changed from about 56/44 with standard emulsion blasting agent (mix 1) to about 40/60 for gassed emulsion blasting agent with 20% energy reducing agent (mix 4). This shift in energy from shock to bubble is highly desirable in blasting operations where wall and perimeter control is required.

The emulsion blasting agent used in mixes 1–4 had the formulation set forth in Table 2 below. Gassing agents were added to mixes 2–4 in the amount of 0.8% by weight.

TABLE 1

| | | | Measured Energy | | | |
|---|---|---|---|---|---|---|
| Mix Number | Density (g/cc) | Velocity (m/s) | Shock (cal/g) | Bubble (cal/g) | Total (cal/g) | Volume Energy (cal/cc) |
| 1 | 1.21 | 6400 | 401 | 317 | 718 | 869 |
| 2 | 0.87 | 4820 | 306 | 359 | 665 | 579 |
| 3 | 0.87 | 3810 | 235 | 313 | 548 | 477 |
| 4 | 0.82 | 4015 | 188 | 286 | 474 | 389 |

TABLE 2

| | % by Weight |
|---|---|
| Oxidizer Solution[1] | 93.4 |
| Fuel Solution[2] | 6.0 |
| Plastic Microballoons | 0.6 |
| Hot Cup Density (g/cc) | 1.13–1.16 |
| Hot Viscosity (cP) (± 1,000 cP, #6 spindle at 50 rpm) | 13,000 |

| [1]Oxidizer Solution: | AN | SN | $H_2O$ |
|---|---|---|---|
| | 69.5 | 13.0 | 17.5 |

| | |
|---|---|
| Fudge Point: | 57–59° C. |
| pH: | 4.5–5.0 |
| Temperature: | 72–75° C. |

| [2]Fuel Solution: | Polymeric Emulsifier | Sorbitan Monooleate | Fuel Oil | Mineral Oil |
|---|---|---|---|---|
| | 20.0 | 5.0 | 37.5 | 37.5 |

| | |
|---|---|
| Temperature: | 60° C. |

EXAMPLE 2

An emulsion blasting agent was formed with that formulation set forth in Table 2. The emulsion blasting agent was pumped into a container having an outlet connected to a pump.

The pump outlet was equipped with a water injector fitting capable of introducing the energy-reducing agent (in this example water). Additionally, the pump outlet also was fitted with a fitting for introducing the gassing agents prior to the water injector. (The gassing agents employed in this example were a 20/30/50 blend of sodium nitrite/sodium thiocyanate/water and a 50/50 blend of water/citric acid. Both agents were used at a level of about 0.4 percent by weight of the emulsion blasting agent.)

The emulsion blasting agent pump and the energy-reducing agent and gassing agent pressurized supply tanks were operated simultaneously and the combined stream of components passed through a mixing device (spray nozzle) attached at the end of a 20-foot long, ¾-inch internal diameter loading hose. Thus the emulsion, energy-reducing agent and gassing agents were mixed uniformly and homogeneously.

This method was used to form two mixtures having about 9 and 14 percent energy-reducing agent (water), respectively. The mixtures were loaded into cardboard tubes (unconfined) ranging in diameter from 1¼ to 3-inch and were allowed to gas from an initial density of 1.42 g/cc to final densities of about 0.85, 0.75 and 0.70 g/cc, respectively. The mixes required from 20 to 30 minutes to gas completely. Detonation results at 20° C. are presented in Table 3.

TABLE 3

| Mix Number | Percent Water | Diameter(in.) | Density(g/cc) | Velocity(ft./s) |
|---|---|---|---|---|
| 1 | 9.0 | 1.25 | | Fail |
| 1 | 9.0 | 2.0 | | 8215 |
| 1 | 9.0 | 2.5 | 0.85 | 8010 |
| 1 | 9.0 | 3.0 | | 9375 |
| 2 | 14.0 | 2.0 | | Fail |
| 2 | 14.0 | 2.5 | 0.75 | 7680 |
| 2 | 14.0 | 3.0 | | 8460 |

EXAMPLE 3

Table 4 shows a series of mixes that contained varying amounts of water of from 0 to 20% by weight of the emulsion (having the same formulation as set forth in Table 2). Detonation results in cardboard tubes (unconfined) show a considerable increase in critical diameter and minimum booster as the percent-added water was increased. Detonation results in the "Steel" pipes, schedule 40 (confined) indicate that all mixes, except mix 8 which had 20% added water, detonated in 38 mm with velocities ranging from 5.4 km/s with no water to 3.6 km/s with 17.5% water.

While the present invention has been described with reference to certain illustrative examples and preferred embodiments, various modifications will be apparent to those skilled in the art and any such modifications are intended to be within the scope of the invention as set forth in the appended claims.

TABLE 4

| | Mix 1 | Mix 2 | Mix 3 | Mix 4 | Mix 5 | Mix 6 | Mix 7 | Mix 8 |
|---|---|---|---|---|---|---|---|---|
| Emulsion | 99.3 | 94.3 | 91.8 | 89.3 | 86.8 | 84.2 | 81.7 | 79.2 |
| % Added Water | 0 | 5.0 | 7.5 | 10.0 | 12.5 | 15.0 | 17.5 | 20.0 |
| Gassing Agents | 0.7 | 0.7 | 0.7 | 0.7 | 0.7 | 0.7 | 0.7 | 0.7 |
| Relative energy at 0.84 g/cc[1] (%) | 70.1 | 64.0 | 61.1 | 58.2 | 55.3 | 52.4 | 49.5 | 46.5 |
| Results[2] at 20° C. | | | | | | | | |
| Density (g/cc) | 0.84 | 0.83 | 0.82 | 0.87 | 0.82 | 0.83 | 0.85 | 0.82 |
| Velocity (km/s) | | | | | | | | |
| 75 mm | 3993 | 3702 | 4312 | 3469 | 3404 | 2605 | 2776 | Fail |
| 63 mm | 3866 | 3539 | 3350 | 3161 | 3386 | 2351 | Fail | — |
| 50 mm | 4057 | 3489 | 3215 | 2960 | 3159 | Fail | — | — |
| 38 mm | 3895 | 3503 | 2981 | Fail | 2863 | — | — | — |
| 32 mm | 4747 | 3298 | 2834 | Fail | Fail | — | — | — |
| 25 mm | 1860 | 2822 | Fail | — | — | — | — | — |
| 75 mm Steel | 4765 | 4951 | 3691 | 4083 | 3842 | 4475 | 4051 | 4219 |
| 50 mm Steel | 3907 | 4212 | 3469 | — | 3735 | 3987 | 3607 | Fail |
| 38 mm Steel | 5381 | 4440 | 3766 | 3633 | 3825 | 3746 | 3587 | — |
| Min. Booster, 75 mm (det/fail)[3] | #8/#6 | #12/#8 | 2 g/#12 | 6 g/2 g | 6 g/2 g | 50/18 g | 90/50 g | — |
| Results[2] at 20° C., 2 weeks | | | | | | | | |
| Density (g/cc) | 0.83 | 0.82 | 0.82 | 0.84 | 0.85 | — | — | — |
| Velocity (km/s) | | | | | | | | |
| 75 mm | 3802 | 3980 | 4312 | 3812 | 3409 | — | — | — |
| 38 mm | — | — | 2981 | 2662 | 2648 | — | — | — |
| 32 mm | 4031 | — | 2834 | — | — | — | — | — |
| 25 mm | Fail | — | — | — | — | — | — | — |
| Min. Booster, 75 mm (det/fail) | #12/#8 | #12/#8 | 6 g/2 g | 6 g/2 g | 6 g/2 g | — | — | — |

[1]Relative bulk energy compared to ANFO energy of 880 kcal/kg.
[2]Shooting results with product in cardboard tubes unless otherwise stated.
[3]#12, 8 and 6 are blasting caps (by strength) and 2 g, 6 g etc., are grams of pentolite.

What is claimed is:

1. A method of reducing the energy of an emulsion blasting agent as it is being loaded into a borehole comprising the steps of:

a) selecting an emulsion blasting agent comprising an aqueous inorganic oxidizer salt solution forming in droplet form a discontinuous phase and an organic liquid fuel forming a continuous phase;

b) conveying the emulsion blasting agent;

c) adding an energy-reducing agent to the emulsion blasting agent as it is being conveyed wherein the energy reducing agent is selected from the group consisting of water and aqueous solutions;

d) mixing the energy-reducing agent uniformly and homogeneously into the emulsion blasting agent to form a second discontinuous phase in an amount of from about 5% to about 22.5% by weight of the emulsion blasting agent;

e) adding gassing agents to the emulsion blasting agent to reduce its density and increase its sensitivity; and f) loading the conveyed emulsion blasting agent into a borehole.

2. A method according to claim 1 wherein the energyreducing agent is added in an amount of from about 7.5% to about 17.5% by weight of the emulsion blasting agent.

3. A method according to claim 1 wherein the aqueous solutions contain solutes selected from the group consisting of inorganic oxidizer salts, urea, glycols and inorganic acids.

4. A method according to claim 1 wherein the gassing agents are added in amounts sufficient to reduce the density of the emulsion blasting agent to a range of from about 0.60 g/cc to about 1.30 g/cc.

5. A method according to claim 1 wherein the borehole is a perimeter borehole.

6. A method according to claim 1 wherein the energy reducing agent and gassing agents are added in varying amounts as the borehole is loaded to impart varying energies and densities to the emulsion blasting agent throughout the length of the borehole.

7. A method according to claim 1 wherein the conveyed emulsion is pumped.

* * * * *